US005129788A

United States Patent [19]

Okayasu

[11] Patent Number: 5,129,788

[45] Date of Patent: Jul. 14, 1992

[54] HEAT-DRIVEN PUMP

[76] Inventor: Kenji Okayasu, 20-15, Mukai-machi, Gyouda-shi, Saitama, 361, Japan

[21] Appl. No.: 754,818

[22] Filed: Sep. 4, 1991

[30] Foreign Application Priority Data

Sep. 10, 1990 [JP] Japan ..... 2-94893[U]

[51] Int. Cl.[5] ..... F04B 19/24

[52] U.S. Cl. ..... 417/52; 417/409

[58] Field of Search ..... 417/207, 208, 209, 52, 417/379

[56] References Cited

U.S. PATENT DOCUMENTS 2,953,100 9/1960 Andrews ..... 417/209

4,792,283 12/1988 Okayasu ..... 417/52

*Primary Examiner*—Leonard E. Smith

*Attorney, Agent, or Firm*—Jordan and Hamburg

[57] ABSTRACT

A heat-driven pump includes a fluid suction port defining unit which introduces liquid into a heating chamber. Bubbles are formed by heating liquid introduced through the fluid suction port defining unit into a heating chamber. The bubbles cause fluid in the heating chamber to flow out through condensation means and enter the condensation means whereas the bubbles are prevented from flowing through the fluid suction port defining unit due to capillary phenomenon of the fluid suction port defining unit. The bubbles are eliminated by cooling in the condensation means, and elimination of the bubbles causes fresh liquid is introduced through the fluid suction port defining unit into the heating chamber, thereby successive pumping of the fluid being performed. The fluid suction port defining unit includes fluid passage defining unit for defining fluid passages for allowing fluid to pass through into the heating chamber whereas the fluid passages prevent the bubbles from passing through due to capillary phenomenon and fluid passage defining unit placing unit for detachably placing the fluid passage defining unit in position.

15 Claims, 8 Drawing Sheets

(a)

(b)

(c)

HEAT-DRIVEN PUMP

BACKGROUND OF THE INVENTION

1. Background of the Invention

The present invention relates to a heat-driven pump, and particularly relates to a heat-driven pump which performs pumping by repeating generation and elimination of bubbles due to heat.

2. Prior Art

FIG. 20 illustrates a heat-driven pump disclosed in U.S. Pat. No. 4,792,283 issued to Applicant on Dec. 20, 1988. The disclosure of this patent is incorporated herein by reference.

In this heat-driven pump 51, a heating chamber 53 which is embedded in a heating portion 52 communicates to a vapor-liquid exchange chamber 54 through two passages: a condensation tube 55 and a liquid suction port 56. The vapor-liquid exchange chamber 54 communicates to both a suction tube 57 and a discharge tube 58. To allow liquid to flow only in a single direction, the suction tube 57 and the discharge tube 58 are connected to a suction side check valve 59 and a discharge side check valve 60, respectively.

The condensation tube 55 opens at an upper end thereof to the vapor-liquid chamber 54. A gap 61 is formed between the upper end of the condensation tube 55 and a lower end of the discharge tube 58 for allowing lquid to directly flow from the suction tube 57 to the discharge tube 58 through the vapor-liquid exchange chamber 54.

The liquid suction port 56 is partitioned into small opening areas by a plurality of radially extending fins 62.

The fins 62 are made of thin stainless plates, and are bonded through an adhesive or welded at regular angular intervals to the outer circumferential surface of the lower end of the condensation tube 55 as illustrated in FIG. 21.

In this heat-driven pump 51, the heating chamber 53 and the vapor-liquid chamber 54 are filled with liquid which is flowing from the suction tube 57. Bubbles are formed from the lower end of the heating chamber 53 by heating the heating portion 52. As a bubble grows, the interface between the bubble and liquid ascends, and then reaches to both the liquid suction port 56 and the lower end of the condensation tube 55. The interface is blocked at the liquid suction port 56 due to a capillary phenomenon caused by radial fins 62, and enters only the condensation tube 55.

During such a process, a volume of liquid which is equal to a volume of the bubble produced forcedly flows out of the heating chamber 53 into the vapor-liquid chamber 54, and is then delivered out through the discharge pipe 58.

The bubble which has entered into the condensation tube 55 is cooled by surrounding liquid, so that it contracts and then disappears. Thus, a volume of liquid which is equal to the volume of the bubble flows from the vapor-liquid exchange chamber 54 into the heating chamber 53 through the liquid suction port 56 and the condensation tube 55. Fresh liquid which is equal in volume to the liquid entered into the heating chamber 53 flows into the vapor-liquid exchange chamber 54 through the suction tube 57.

In this fashion, pumping of liquid is carried out by repeating production and elimination of bubbles caused by heat.

To fabricate the heat-driven pump 51, it is necessary to bond or weld each of radial fins 62 to the outer circumferential surface of the lower end of the condensation tube 55, and hence it is laborious to assemble the radial fins 62. Furthermore, radial fins 62 are liable to be separated from the condensation tube 55.

SUMMARY OF THE INVENTION

Accordingly, it is an object of the present invention to provide a heat-driven pump of which suction port is less laborious in fabrication and less liable to be broken than that of the heat-driven pump according to the prior art.

With this and other objects in view, the present invention provides a heat-driven pump of the type in which: bubbles are formed by heating liquid introduced through fluid suction port defining means into a heating chamber; the bubbles cause fluid in the heating chamber to flow out through condensation means, and enter the condensation means whereas the bubbles are prevented from flowing through the fluid suction port defining means due to a capillary phenomenon of the fluid suction port defining means; the bubbles are eliminated by cooling in the condensation means; and elimination of the bubbles causes fresh liquid is introduced through the fluid suction port defining means into the heating chamber, thereby pumping of the fluid being performed, the improvement wherein the fluid suction port defining means comprises: fluid passage defining means for defining fluid passages for allowing fluid to pass through into the heating chamber whereas the fluid passages prevent the bubbles to pass through due to the capillary phenomenon; and fluid passage defining means placing means for detachably placing the fluid passage defining means in position.

BRIEF DESCRIPTION OF THE DRAWINGS

FIG. 4(*b*) is a bottom view of the retainer with the fin of FIG. 4(*a*).

FIG. 4(*c*) is a perspective of the retainer of FIG. 4(*a*).

FIG. 7(*b*) is a bottom view of the fin of FIG. 7(*a*).

FIG. 13(*b*) is a bottom view of the concentric tubes in FIG. 13(*a*).

FIG. 22(*b*) is a bottom view of the suction port defining unit of FIG. 22(*a*).

FIG. 22(*c*) is a perspective view of the suction port defining unit of FIG. 22(*a*).

DETAILED DESCRIPTION OF THE PREFERRED EMBODIMENTS

Figure 1:
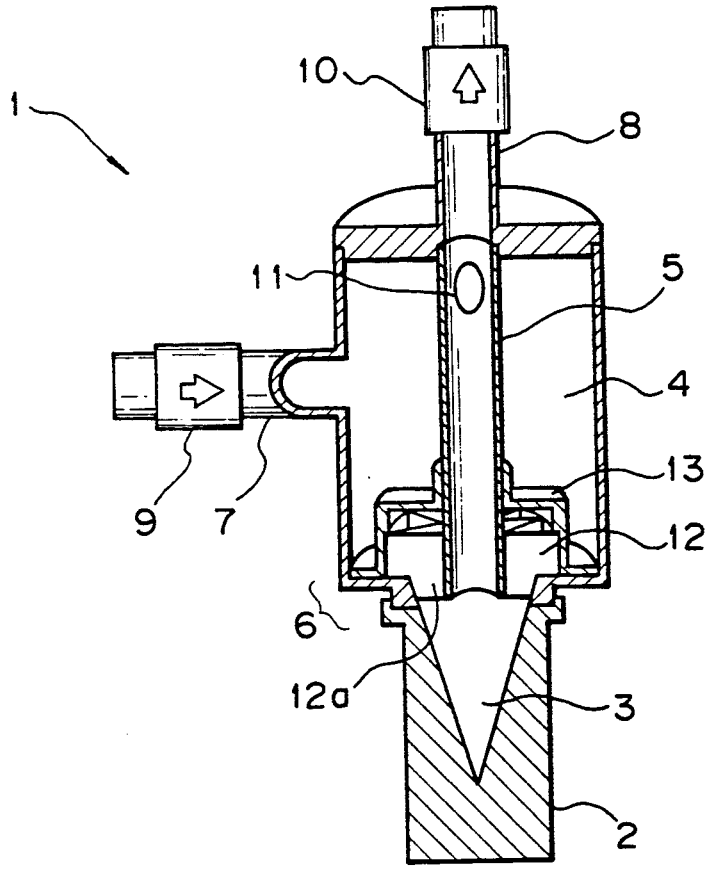
FIG. 1 is an axial sectional view of a heat-driven pump as one embodiment of the present invention.

Referring to the drawings, several embodiments of the present invention will be described hereinafter.

FIG. 1 illustrates a heat-driven pump 1 as one embodiment of the present invention.

In this heat-driven pump 1, a heating chamber 3, embedded in a heating portion 2, and a vapor-liquid exchange chamber 4 communicate to each other through two passages: a condensation tube 5 and a liquid suction port 6.

The vapor-liquid exchange chamber 4 is connected to a suction tube 7 and a discharge tube 8. To cause fluid to flow only in one way, the suction tube 7 is connected to a suction-side check valve 9 whereas the discharge tube 8 a discharge-side check valve 10.

The condensation tube 5 is provided in an upper end portion thereof with an opening 11 for allowing part of fluid to directly flow from the suction tube 7 to the discharge tube 8 through the vapor-liquid exchange chamber 4.

The liquid suction port 6 is partitioned by an annularly folded fin 12 into small partitioned opening areas.

Figure 2:
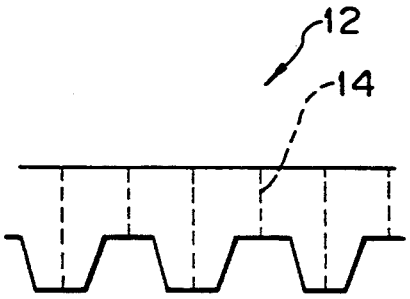
FIG. 2 is an enlarged fragmentary extended view of the fin of FIG. 1.
Figure 3:
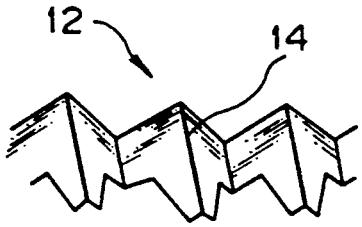
FIG. 3 is a perspective view of the fin in FIG. 2.
Figure 4:
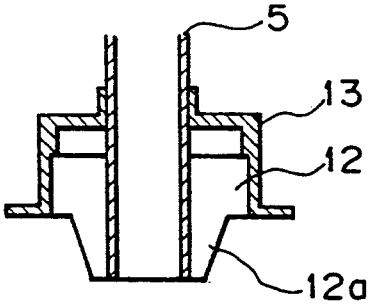
FIG. 4(*a*) is an enlarged axial sectional view of the retainer with the fin of FIG. 1, the retainer being fitted around the condensation tube.
Figure 4:
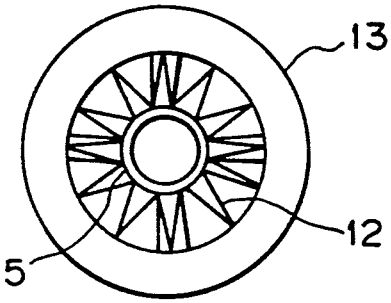
Figure 4:
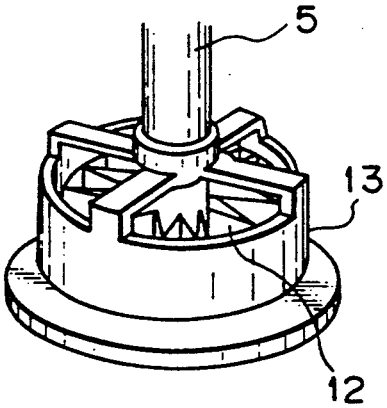

The fin 12 is formed by corrugating a substantially strip shaped metallic thin plate at perforations 14 as shown in FIG. 2 and FIG. 3 and then by bending it annularly. The perforations 14 are formed by laser beam machining, etching, etc. The fin 12 is provided at a lower edge thereof with lower projections 12*a* formed at regular intervals. As illustrated in FIG. 1 and FIGS. 4(*a*) to 4(*c*), the fin 12 is placed around the condensation tube 5 at a lower end thereof, and is received within a retainer 13, which is fitted around the condensation tube 5 to come into contact with the bottom of a housing, which defines the vapor-liquid exchange chamber 4, and to cover the bottom opening of the housing. The fin 12 is held within the retainer 13 with lower projections 12*a* fitted into the heating chamber 3. The retainer 13 is substantially in the shape of an inverted cup, and is provided at the top thereof with four spokes which form four openings between them as shown in FIG. 4(*c*). The fin 12, the retainer 13 and the lower end portion of the condensation tube 5 define the liquid suction port 6.

As illustrated in FIG. 4(*b*), the fin 12 partitions the liquid suction port 6 into many partitioned chambers with triangle cross-sections (maximum width of about 1 mm in case with stainless as fin 12 and water as liquid) for producing a capillary phenomenon.

In this heat-driven pump 1, the heating chamber 3 and the vapor-liquid exchange chamber 4 are filled with liquid which flows in from the suction tube 7, and then a bubble is formed from the lower end of the heating chamber 3 by heating the heating portion 2. As the bubble grows, the interface between the bubble and the liquid ascend to both the liquid suction port 6 and the lower end of the condensation tube 5. The interface is prevented from entering the liquid suction port 6 due to capillary phenomenon of the liquid produced by the fin 12, and hence enters only into the condensation tube 5.

In this process, a volume of liquid which is equal to the volume of the bubble produced flows out of the heating chamber 3 to the vapor-liquid exchange chamber 4. The volume of water flowing out is delivered through the discharge tube 8.

The bubble which has entered the condensation tube 15 is cooled and condensed by surrounding liquid, so that it contracts and disappears. Thus, a volume of liquid which corresponds to the volume of the bubble flows from the vapor-liquid exchange chamber 4 to the heating chamber 3 through the liquid suction port 6 and the opening 11 of the condensation tube 5, and in turn this volume of fresh liquid is supplied from the suction tube 7.

In such a manner, pumping of liquid is achieved by repeating production and elimination of bubbles due to heat.

Figure 5:
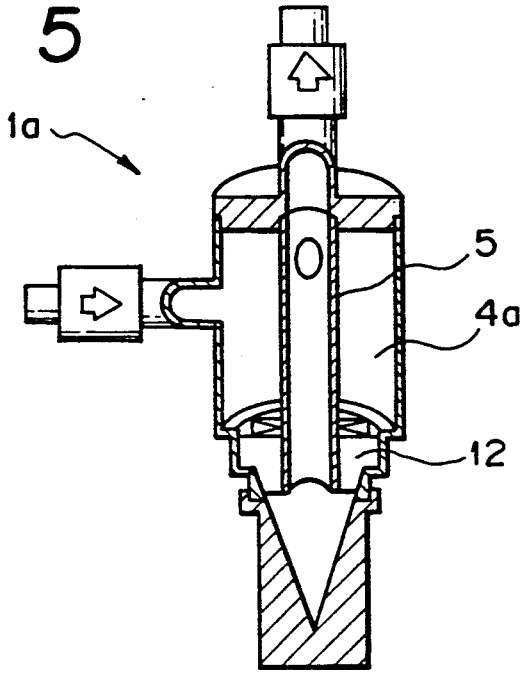
FIG. 5 is an axial sectional view of a heat-driven pump as another embodiment of the present invention.

FIG. 5 illustrates a heat-driven pump 1*a* as another embodiment of the present invention.

In this embodiment, the heat-driven pump 1*a* includes a pump housing which has a reduced diameter portion at the lower portion thereof. A fin 12 is received within a space defined by both the reduced diameter portion and a lower end portion of the condensation tube 5, so that in the space there are formed many partitioned chambers with a substantially triangle cross-section for producing a capillary phenomenon. The fin 12, the reduced diameter portion and the lower end portion of the condensation tube 5 define a liquid suction port 6. This embodiment obviates the retainer 3 of the heat-driven pump 1, and has the same structure as the first embodiment in the other points.

Figure 6:
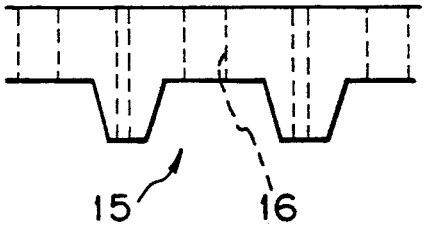
FIG. 6 is an enlarged extended view of the fin of FIG. 5.
Figure 7:
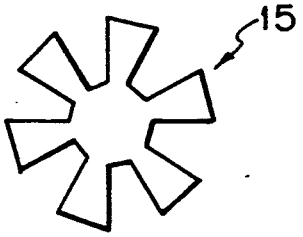
FIG. 7(*a*) is an enlarged perspective view of the fin of FIG. 5.
Figure 7:
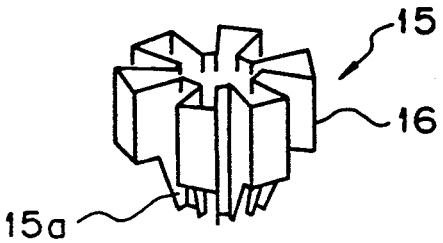

FIG. 6 shows a modified fin 15 of the fin of FIG. 1. This modified fin 15 is formed by corrugating a thin metallic strip at perforations 16 and then by bending like a toothed wheel as illustrated in FIG. 7(*a*) and FIG. 7(*b*). As in the first and the second embodiment, this fin 15 is received and held within the retainer 13 or the liquid suction port 6 with lower projections 15*a* fitted into the heating chamber 3.

This fin 15 partitions liquid suction ports 6 into many partitioned chambers with a trapezoid cross-section as illustrated in FIG. 7(*b*) for generating capillary phenomenon, and thereby blocks flowing of bubbles through the liquid suction ports 6. The fin 15 provides partitioned chambers with substantially the same cross-sectional shape, and hence uniform capillary phenomenon is produced everywhere in the liquid suction ports 6.

Figure 8:
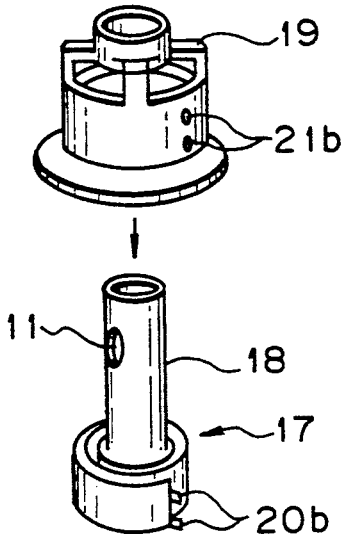
FIG. 8 is an illustration of a fluid passage defining member of a heat-driven pump as a still another embodiment of the present invention.
Figure 9:
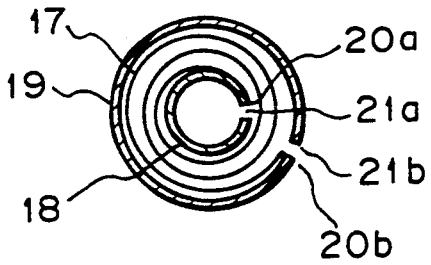
FIG. 9 is a radial sectional view of the fluid passage defining member of FIG. 8, the fluid passage defining member being received within the retainer.

A passage defining member 17 of a heat-driven pump as another embodiment is illustrated in FIG. 8 and FIG. 9.

The passage defining member 17 is formed by spirally bending a thin metallic strip. The passage defining member 17 is received and secured in a retainer 19 in such a manner that claws 20*a* of the inner end thereof are inserted into holes 21*a* of the condensation tube 18, while claws 20*b* of the outer end thereof inserted into holes 21*b* of the retainer 19.

As shown in FIG. 9, the passage defining member 17 defines a narrow spiral fluid suction port 6 within the space between the retainer 19 and the condensation tube 5 so that a capillary phenomenon is produced in the fluid suction port 6. It is thus possible to prevent bubbles formed within the heating chamber 3 from flowing out through the fluid suction port 6. The spiral fluid suction port may be changed in thickness with ease by changing the number of the turn of the spiral of the passage defining member 17.

Figure 10:
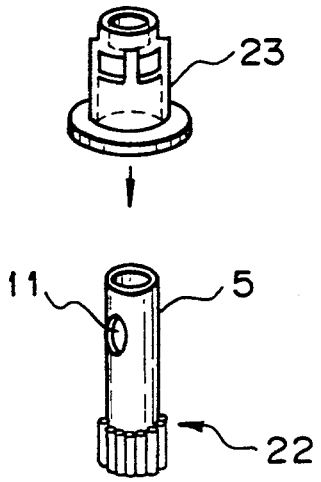
FIG. 10 is an illustration of how to arrange a group of fine tubes, used in a heat-driven pump as another embodiment of the present invention, within a retainer.
Figure 11:
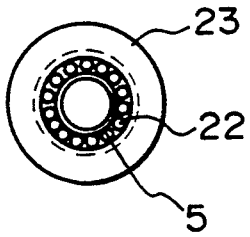
FIG. 11 is a bottom view of the group of the fine tubes arranged within the retainer.

FIG. 10 and FIG. 11 illustrate a group of capillary tubes 22 of a heat-driven pump as another embodiment of the present invention.

The group of the capillary tubes 22 are received within a retainer 23 around the lower end portion of a condensation tube 5 so that the capillary tubes 22 are arranged parallel with condensation tube 5, i.e., the direction of flow of liquid in the liquid suction port 6.

As illustrated in FIG. 11, the liquid suction port 6 is separated into many narrow passages for producing capillary phenomenon, and thereby bubbles formed in the heating chamber 3 are blocked from flowing out through the liquid suction port 6.

Figure 12:
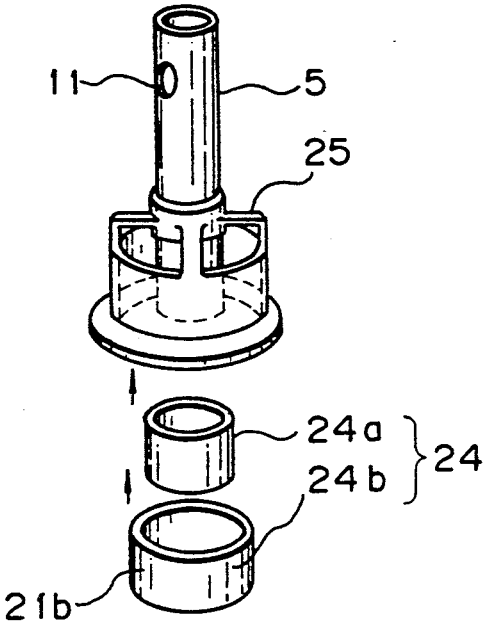
FIG. 12 is an illustration of how to arrange a pair of concentric tubes, used in a heat-driven pump as another embodiment of the present invention, within a retainer.

FIG. 12 shows a concentric tube group 24 of a heat-driven pump as a still another embodiment of the present invention.

The concentric tube group 24 includes an inner circular tube 24*a* and an outer circular tube 24*b* fitted around the inner circular tube 24*a*. The inner circular tube 24*a* is larger in diameter than the condensation tube 5, and the outer circular tube 24*b* is smaller in diameter than the retainer 23. The inner and outer tubes 24*a* and 24*b* are fitted around a lower end portion of the condensation tube 5, and are received within the retainer 23 so that the tubes 24*a* and 24*b* are concentric with the condensation tube 5.

Figure 13:
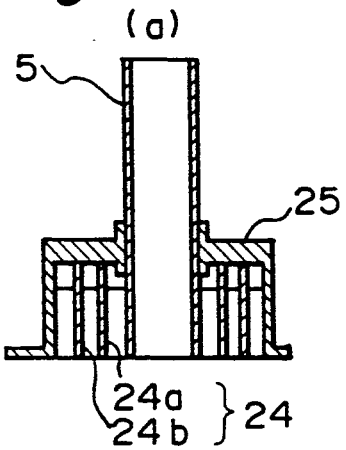
FIG. 13(*a*) is an axial sectional view of the pair of concentric tubes disposed of FIG. 12 within the retainer.
Figure 13:
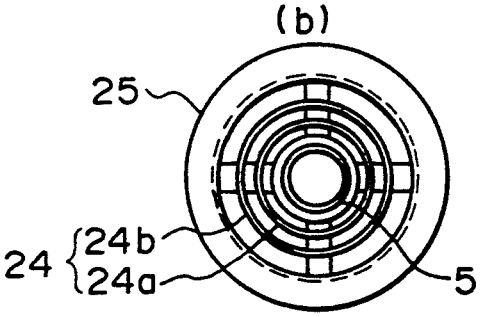

The inner and outer tubes 24*a* and 242*b* are joined, for example welded or brazed, at upper edges thereof to the spokes of the retainer 23 as illustrated in FIG. 13(*a*), As shown in FIG. 13(*b*), the inner and outer tubes 24*a* and 24*b* partition a liquid suction port 6 into small annular gaps so that a capillary phenomenon may be produced in the annular gaps. Thus, bubbles are prevented by the inner and outer tubes 24*a* and 24*b* from flowing through the liquid suction port 6.

Figure 14:
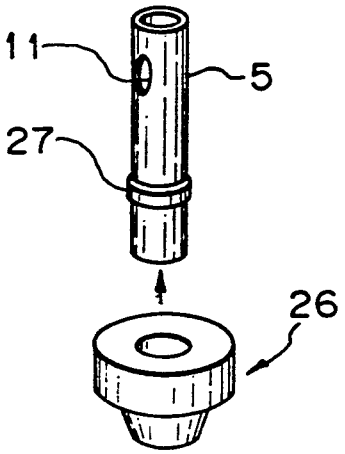
FIG. 14 is an illustration of how to arrange a plug, used in a still another embodiment of the present invention, around a condensation tube.

FIG. 14 illustrates a plug 26 of a heat-driven pump as another embodiment of the present invention.

The plug 26 is made of foamed material, such as a foamed metal and a foamed ceramic, having open cells. The plug 26 is concentrically fitted around the lower end of a condensation tube 5, and is located at the bottom of the vapor-liquid exchange chamber 4 by clamping it between a holding ring 27 and the bottom opening (FIG. 1). In this event, a frustoconical portion of the plug 26 is fitted into the bottom opening.

In this embodiment, small open cells of the plug 26 define a liquid suction port 6 for producing a capillary phenomenon, and thereby bubbles are prevented by the plug 26 from flowing through it.

Figure 15:
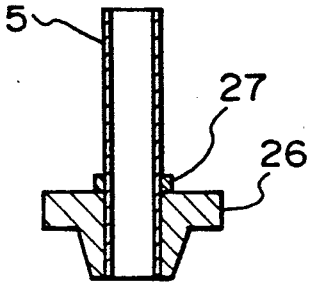
FIG. 15 is an axial sectional view of the plug, fitted around the condensation tube, of FIG. 14.

As shown in FIG. 15, the plug 26 has a substantially frustoconical axial section.

Figure 16:
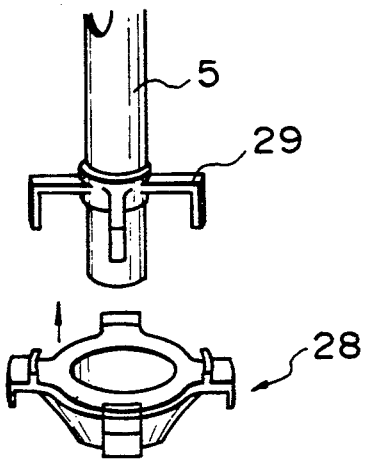
FIG. 16 is an illustration of how to dispose a fluid passage defining member in position around a condensation tube of another embodiment of the present invention.
Figure 17:
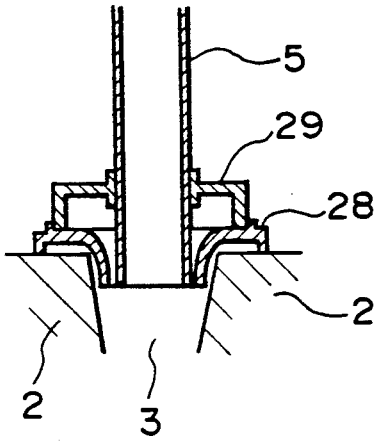
FIG. 17 is an axial sectional view of the fluid passage defining member placed in position around the condensation tube of FIG. 16.

FIG. 16 and FIG. 17 show a passage defining member 28 of still another embodiment of the present invention.

The passage defining member 28 is in the shape of a funnel. The passage defining member 28 is partly inserted into the bottom opening of the housing with the narrower opening thereof directed downwardly, and is secured to the bottom of the vapor-liquid exchange chamber 4 by clamping at a flange of the larger opening thereof between the bottom and securing arms of a securing ring 29 attached around a lower end portion of the condensation tube 5.

The liquid suction port 6 is separated at an opening toward the heating chamber 3 into two narrow concentric annular gaps by the passage defining member 28 for producing a capillary phenomenon to block flowing of bubbles, produced in the heating chamber 3, through the liquid suction port 6. The inner annular gap is defined between the passage defining member 28 and the lower end portion of the condensation tube 5. The outer annular gap is formed between the passage defining member 28 and the wall of the bottom of the vapor-liquid exchange chamber 4.

Figure 18:
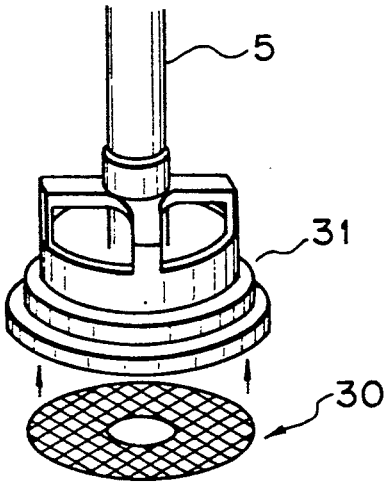
FIG. 18 is an illustration of how to dispose a mesh member within a retainer of another embodiment of the present invention.
Figure 19:
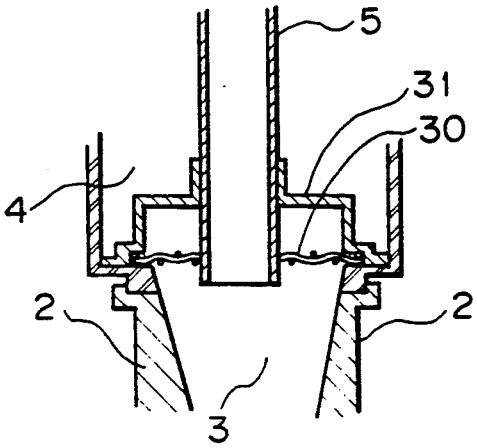
FIG. 19 is an axial sectional view of the mesh member arranged in position within the retainer of FIG. 18.
Figure 20:
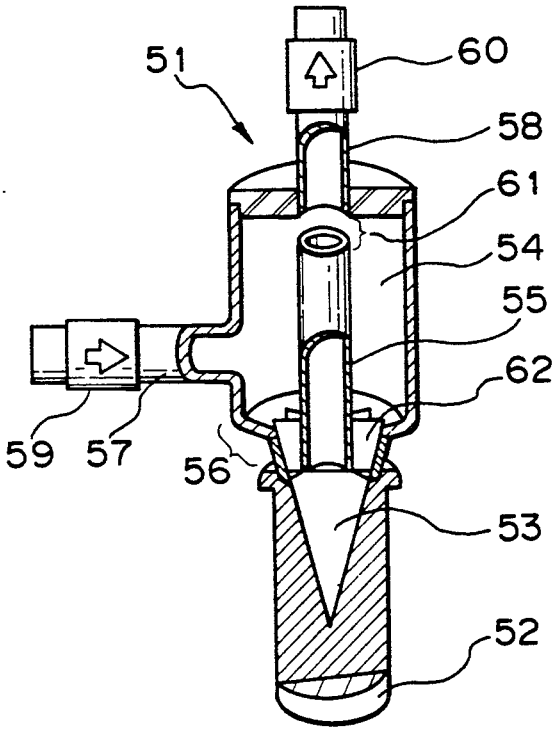
FIG. 20 is an axial sectional view of the heat-driven pump according to the prior art.
Figure 21:
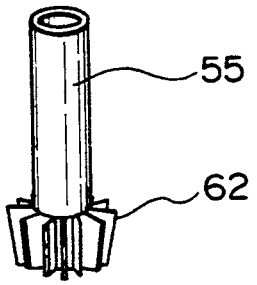
FIG. 21 is a perspective view of the fins mounted around the condensation tube of FIG. 20.

A mesh 30 used in a liquid suction passage 6 of another embodiment of the present invention is illustrated in FIG. 18 and FIG. 19.

The mesh 30 is made of a metal, a plastic or a like material. The mesh 30 is fitted around a lower end of the condensation tube 5, and is secured in the bottom of the housing by clamping between the periphery of the bottom opening and a circumferential shoulder of a retainer 31 for covering the bottom opening as shown in FIG. 19.

The fluid suction port 6 is partitioned at the mesh 30 into small meshes so that a capillary phenomenon is generated to block the flowing of bubbles from the heating chamber 3 through fluid suction port 6.

The magnitude of the capillary phenomenon is adjustable by changing the mesh 30 to another one having a different size of meshes or by using a plurality of meshes.

Figure 22A:
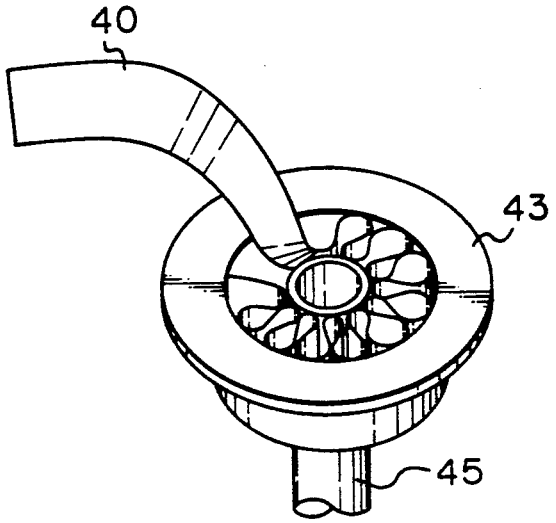
FIG. 22(*a*) is an illustration of a suction port defining unit of a heat-driven pump as a still another embodiment of the present invention.
Figure 22B:
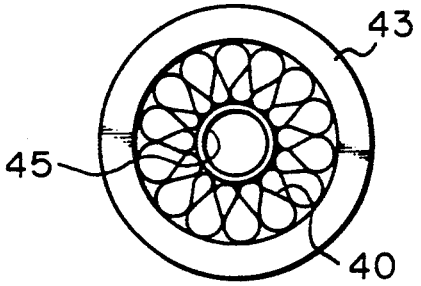
Figure 22C:
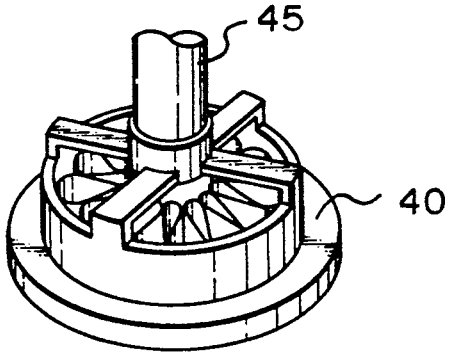

FIG. 22(*a*) is an illustration as to how to construct a suction port defining unit of a heat-driven pump as a still another embodiment of the present invention.

An elongated metallic strip 40 is resilientry bent and placed in the shape of a meander in a space defined between a retainer 43 and a condensation tube 45, and the opposite end portions thereof are brought into contacat to each other. The metallic strip 40 is thus received and held annularly as a whole in the retainer 43 by a resilent restoring force thereof, so that the metallic strip 40 defines a suction port in cooperation with the retainer 43 and the condensation tube 45.

FIG. 22(*b*) and FIG. 22(*c*) are bottom and perspective views of the suction port defining unit, respectively.

What is claimed is:

1. A heat-driven pump of the type in which: bubbles are formed by heating liquid introduced through fluid suction port defining means into a heating chamber; the bubbles cause fluid in the heating chamber to flow out through condensation means, and enter the condensation means whereas the bubbles are prevented from flowing through the fluid suction port defining means due to a capillary phenomenon of the fluid suction port defining means; the bubbles are eliminated by cooling in the condensation means; and elimination of the bubbles causes fresh liquid is introduced through the fluid suction port defining means into the heating chamber, thereby pumping of the fluid being performed, the improvement wherein the fluid suction port defining means comprises: fluid passage defining means for defining fluid passages for allowing fluid to pass through into the heating chamber whereas the fluid passages prevent the bubbles to pass through due to the capillary phenomenon; and fluid passage defining means placing means for detachably placing the fluid passage defining means in position.

2. A heat-driven pump as recited in claim 1, wherein the fluid passage defining means comprises an annular corrugated strip member bent longitudinally to define narrow openings for introducing liquid and producing the capillary phenomenon.

3. A heat-driven pump as recited in claim 2, wherein: the condensation means comprises a condensation tube having a lower end; the fluid passage defining member comprises the lower end of the condensation tube; and the annular corrugated strip member is disposed around the lower end of the condensation tube.

4. A heat-driven pump as recited in claim 1, wherein: the fluid passage defining means comprises a spiral strip member longitudinally spirally bent to define a narrow spiral opening for introducing liquid and producing the capillary phenomenon.

5. A heat-driven pump as recited in claim 4, wherein: the condensation means comprises a condensation tube having a lower end; the fluid passage defining member comprises the lower end of the condensation tube; and the spiral strip member is disposed around the lower end of the condensation tube.

6. A heat-driven pump as recited in claim 1, wherein: the fluid passage defining means comprises a group of parallel tubes to define narrow passages for introducing liquid and producing the capillary phenomenon.

7. A heat-driven pump as recited in claim 6, wherein: the condensation means comprises a condensation tube having a lower end; the fluid passage defining member comprises the lower end of the condensation tube; and the group of parallel tubes are disposed around the lower end of the condensation tube in parallel with the lower end.

8. A heat-driven pump as recited in claim 1, wherein: the fluid passage defining means comprises fluid passage defining tubes concentrically disposed to surround each other to define an annular gap therebetween for introducing liquid and producing the capillary phenomenon.

9. A heat-driven pump as recited in claim 8, wherein: the condensation means comprises a condensation tube having a lower end; the fluid passage defining means comprises the lower end of the condensation tube; and the fluid passage defining tubes are concentrically disposed around the lower end of the condensation tube.

10. A heat-driven pump as recited in claim 1, wherein: the fluid passage defining means comprises a foamed plug member having open cells for introducing liquid and producing the capillary phenomenon.

11. A heat-driven pump as recited in claim 10, wherein: the condensation means comprises a condensation tube having a lower end; the fluid passage defining means comprises the lower end of the condensation tube; and the plug member is placed around the lower end of the condensation tube.

12. A heat-driven pump as recited in claim 1, wherein: the fluid passage defining means comprises a funnel shaped fluid defining member having a smaller open end, the funnel shaped fluid defining member being disposed with the smaller open end directed downwardly for introducing liquid and producing the capillary phenomenon.

13. A heat-driven pump as recited in claim 12, wherein: the condensation means comprises a condensation tube having a lower end; the fluid passage defining means comprises the lower end of the condensation tube; and the funnel shaped fluid defining member is placed around the lower end of the condensation tube, whereby an annular gap is defined between the smaller open end and the lower end of the condensation tube.

14. A heat-driven pump as recited in claim 1, wherein: the fluid passage defining means comprises a mesh member, the mesh member having meshes of such a size as to introduce liquid and produce the capillary phenomenon.

15. A heat-driven pump as recited in claim 14, wherein: the condensation means comprises a condensation tube having a lower end; the fluid passage defining means comprises the lower end of the condensation tube; and the mesh member is fitted around the lower end of the condensation tube.

* * * * *